United States Patent [19]

Jespersen et al.

[11] 4,177,892

[45] Dec. 11, 1979

[54] CONVEYOR COMPRISING A DRIVEN FLEXIBLE BELT FOR STEPWISE ADVANCING MOULDS

[75] Inventors: Emil Jespersen, Glostrup; Vagn Mogensen, Gentofte, both of Denmark

[73] Assignee: Dansk Industri Syndikat AS, Herlev, Denmark

[21] Appl. No.: 804,367

[22] Filed: Jun. 7, 1977

[30] Foreign Application Priority Data

Sep. 24, 1976 [DK] Denmark ..... 4327/76

[51] Int. Cl.[2] ..... B65G 23/38

[52] U.S. Cl. ..... 198/832; 226/162

[58] Field of Search ..... 198/832, 833, 859; 226/162

[56] References Cited

U.S. PATENT DOCUMENTS

| | | | |
|---|---|---|---|
| 2,755,085 | 7/1956 | Giani | 226/162 |
| 2,943,726 | 7/1960 | Granath | 198/859 |
| 3,199,448 | 8/1965 | Jaffa et al. | 226/162 |
| 3,819,073 | 6/1974 | Asselborn et al. | 226/162 |

*Primary Examiner*—Jeffrey V. Nase

*Attorney, Agent, or Firm*—Imirie & Smiley

[57] ABSTRACT

A conveyor on which a casting mould consisting of closely juxtaposed mould parts is advanced stepwise, comprises a section formed by an endless flexible belt. Extending along the side edges of this belt are reciprocating coupling parts which during at least part of their forward stroke are firmly clamped to the edge portions of the belt, from which they are released during their return stroke. In this way elastic extensions and retractions of the flexible belt are excluded.

2 Claims, 2 Drawing Figures

CONVEYOR COMPRISING A DRIVEN FLEXIBLE BELT FOR STEPWISE ADVANCING MOULDS

BACKGROUND OF THE INVENTION

For the stepwise advance of casting moulds consisting of closely juxtaposed mould parts presenting pouring cavities at vertical joint faces between successive mould parts, conveyors are known which comprise a driven, endless, flexible belt. Such a belt may form a continuation of a stationary bed, or pouring channel, which provides a stable support and guiding path for the mould during the pouring operation and, through its friction against the underside of the mould, contributes to keeping the mould parts in close juxtaposition. In smaller units in particular, cooling of the mould containing the castings may also take place on the bed, but often it is desirable to achieve a reduction in the total frictional resistance to the advance of the mould, and to this end the terminating section of the guiding path may be a belt conveyor as referred to above. The flexible belt of the conveyor may be a conventional endless rubber or steel belt but may also consist of wire gauze or hinged slats, and it is known to run such a belt around end rollers, of which at least one is driven in such a way as to drive the mould-carrying belt upper part in the forward direction synchronously with the advance of the mould on the stationary bed. This shall prevent opening and re-closing of the mould at the transition between the bed and the belt, and shall also prevent the risk of deformation or crushing of the mould standing on the bed. Consequently, by a suitable control of the belt movement, a desired weighting between successive mould parts is aimed at.

In practice, however, it has proved very difficult to achieve this object, and moreover it has been ascertained that the mould supported on the belt is not kept stably together but has a tendency to open at the joints. Under such conditions the castings may suffer from cooling damages even if they normally have fully or partially solidified during this phase of the advance movement, and if the counterpressure from the belt exceeds a certain value, pressure damages may be inflicted to the mould supported on the bed.

These adverse conditions must be attributed to the fact that any flexible conveyor belt has a certain longitudinal elasticity and is, therefore, slightly extended during the acceleration of the mould, while it retracts correspondingly during the braking phase. Even in the case of a very precise control of the belt movement with respect to start, travel and stop, it will in practice not be possible to compensate for these small elastic deformations, and even if the detrimental effect thereof can be reduced by transferring only part of the force, required for advancing the mould, via the belt, while the remainder of the force is exerted via a pressure on the mould part last added, this does not prevent the tendency of the mould to open at the joints and avoiding, with safety, deformation of the mould part or parts last added.

The primary object of the invention is to provide a particular belt driving mechanism by which the longitudinal elastic deformations of the belt are avoided or at any rate reduced to an entirely unharmful minimum.

SUMMARY OF THE INVENTION

According to the invention, the belt driving mechanism comprises a pair of opposed, longitudinally non-elastic, rod-shaped coupling parts which extend along the side edges of the belt and are reciprocable in the direction of advance and arranged for being firmly clamped, at least during part of their forward travel, to the edge portions of the belt over a substantial part of the length of the advance path.

In this case the transfer of power to the belt is not only distributed over a considerable part of the length of the belt but it is also effected by means of elements, which function as an intermittent longitudinal reinforcement of the belt during the advance steps, i.e. just over the periods giving risk of mould opening or deformation.

DETAILED DESCRIPTION OF THE PREFERRED EMBODIMENT

Figure 1:
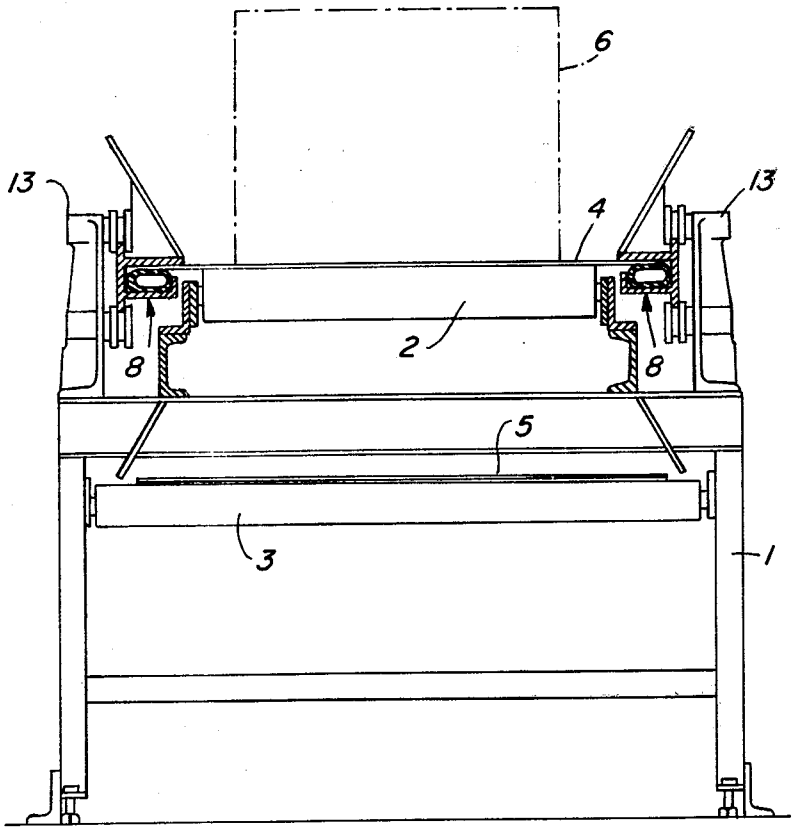
FIG. 1 is a cross-sectional view of a preferred embodiment of the novel conveyor.

The conveyor shown comprises a frame 1 having journals for rollers 2 and 3 supporting an upper run 4 and a lower run 5, respectively, of an endless flexible conveyor belt which at the ends of the conveyor is passed around reversing rollers, not shown. As indicated in FIG. 1, the belt upper run 4 supports a mould 6 which is here assumed to consist of closely juxtaposed identical mould parts having pouring cavities at their vertical joint faces.

Figure 2:
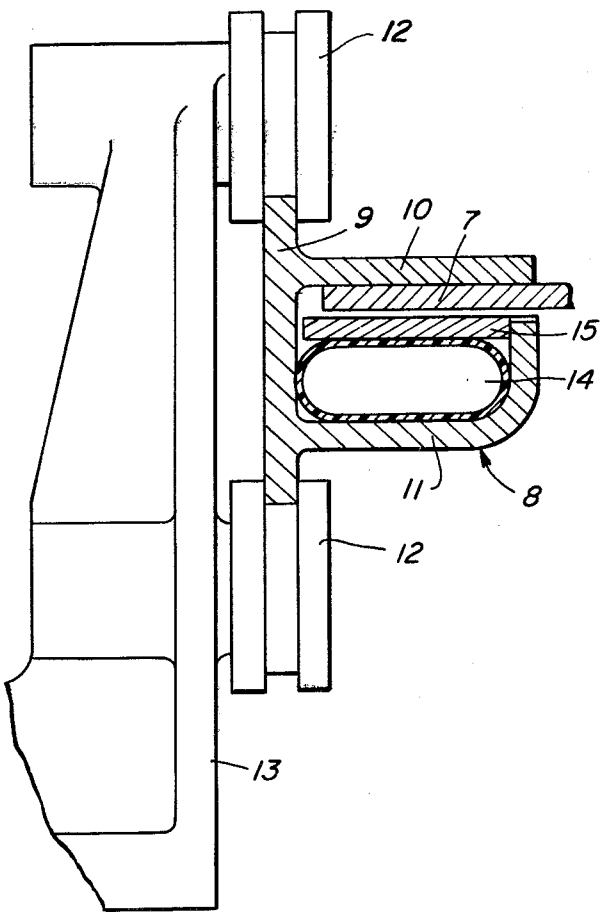
FIG. 2 shows part of said cross-sectional view on a larger scale.

The width of the belt 4, 5 is somewhat wider than the length of the upper set of rollers 2 so that the belt upper run has a protruding edge portion 7 at either side, FIG. 2. Over a substantial part of the conveyor length and extending along the edge portions, rod-shaped coupling parts 8 are provided which are substantially non-elastic in their longitudinal direction and each comprises a vertical web plate 9 and a pair of flanges 10 and 11 located above and below the belt portions 7, respectively. The upper and lower edges of the web plate 9 are in engagement with guiding rollers 12 journalled in brackets 13 on the frame 1 and allowing the coupling parts 8 to be reciprocated in parallel with belt run 4. A mechanism serving this purpose is not shown in the drawing since it may be of a well-known type.

The upper flange 10 constitutes a rail integral with the web 9 and having its underside level with the upper surface of the belt run 4. The lower flange 11 constitutes the bottom and one side of a chamber accomodating a tube section 14 supporting a vertically movable rail 15 which in its inoperative position, shown in FIG. 2, is spaced slightly below the underside of the belt edge portion 7. By guiding means, such as, for example, the web plate 9 and a vertical flange 16 of the coupling part 8, the rail 15 is prevented from moving relative to the rail 10 otherwise than vertically towards and away therefrom. By pneumatic or hydraulic inflation of the tube section 14, the rail 15 is raised so as to firmly clamp the belt edge portion 7 to the coupling part 8. This clamping or locking action is maintained during at any rate part of the forward stroke of coupling parts 8, whereas said action is released by relieving the pressure in the tube section 14 during the return stroke.

The rail 15, and if desired, also the rail 10 may be divided into several sections so that the clamping action may be concentrated on a number of points instead of being distributed substantially evenly over the entire length of the coupling parts.

Further, it should be noted that the rail 10 rigidly connected to the web 9 may be located below, and tube section 14 above, the edge portion 7.

Finally, it should be pointed out that the tube section 14 may be substituted a suitable number of separate pressure cylinders or, if desired, mechanically or hydraulically operated lifters.

What is claimed is:

1. A conveyor for the stepwise advance of a plurality of casting moulds including a plurality of aligned closely juxtaposed mould parts having pouring cavities at joint faces between successive mould parts, comprising a frame, a flexible mould supporting belt carried by said frame so as to be movable in its longitudinal direction, and a driving mechanism to impart a stepwise longitudinal movement to said belt, said driving mechanism including a pair of elongate and substantially non-extensible coupling parts extending reciprocably along the opposite side edges of said belt and each comprising means selectively to clamp the respective coupling parts to the respective side edge portions of the belt over a substantial length thereof, and to release the coupling parts from said side edge portions, said coupling parts including, longitudinally extending parallel brackets disposed along corresponding portions of opposite sides of said frame, two sets of rollers rotatably supported by each said bracket with the axes of each set coplanar with each other and also the corresponding set on the other said bracket, the planes of said sets of rollers respectively being above and below the plane of said belt, a web plate movably mounted between said sets of rollers on each bracket for reciprocation longitudinally of said belt, a first flange rail rigidly supported by each web plate and extending in parallel overlying relation with the adjacent longitudinal edge portion of said belt, a second flange rail rigidly supported by each web plate parallel with said first flange rail and belt and underlying the adjacent longitudinal edge portion of said belt the surface of one of said flange rails adjacent said belt being substantially level with the adjacent surface of said belt, an expansible means carried by said other flange rail between said rail and the adjacent surface of said belt and extending longitudinally of said rail, and a clamping rail carried by said expansible means for movement into and from engagement with the adjacent surface of said belt according to the expansion of said expansible means, whereby said belt is firmly clamped along its opposite edges uniformly along the full length of said clamping rails to retain said belt in a firm, flat condition as the belt with the moulds thereon is advanced by said clamping rails.

2. Apparatus according to claim 1 wherein said expansible means comprises an elongate tube extending the full length of said clamping rails.

* * * * *